US008290391B2

(12) United States Patent
Kawahara

(10) Patent No.: US 8,290,391 B2
(45) Date of Patent: Oct. 16, 2012

(54) CLEANING MEMBER, CLEANING DEVICE, ASSEMBLY, AND IMAGE FORMING DEVICE

(75) Inventor: Ichiro Kawahara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 12/885,025

(22) Filed: Sep. 17, 2010

(65) Prior Publication Data

US 2011/0170899 A1 Jul. 14, 2011

(30) Foreign Application Priority Data

Jan. 13, 2010 (JP) ..... 2010-005268

(51) Int. Cl.
*G03G 15/02* (2006.01)
*G03G 21/00* (2006.01)

(52) U.S. Cl. ..... 399/100; 399/357; 15/256.52

(58) Field of Classification Search ..... 399/100, 399/101, 326, 353, 357; 15/256.51, 256.52; 101/425

See application file for complete search history.

(56) References Cited

U.S. PATENT DOCUMENTS

| | | | | |
|---|---|---|---|---|
| 3,610,693 | A * | 10/1971 | Solarek | 300/21 |
| 4,870,465 | A * | 9/1989 | Lindblad et al. | 399/347 |
| 5,398,102 | A | 3/1995 | Wada et al. | |
| 6,688,094 | B2 * | 2/2004 | Berndt et al. | 56/249 |
| 7,734,212 | B2 * | 6/2010 | Miyaji et al. | 399/100 |
| 2011/0170896 | A1 * | 7/2011 | Yamaguchi | 399/100 |
| 2011/0170900 | A1 * | 7/2011 | Suto | 399/100 |
| 2012/0076528 | A1 * | 3/2012 | Nonaka et al. | 399/100 |

FOREIGN PATENT DOCUMENTS

| | | | |
|---|---|---|---|
| JP | 62163082 | A * | 7/1987 |
| JP | 01237589 | A * | 9/1989 |
| JP | 5-142920 | A | 6/1993 |
| JP | 05232848 | A * | 9/1993 |
| JP | 05-297686 | A | 11/1993 |
| JP | 8-137208 | A | 5/1996 |
| JP | 2002-091134 | A | 3/2002 |
| JP | 2007014369 | A * | 1/2007 |
| JP | 2008-096822 | A | 4/2008 |
| JP | 2008-145566 | A | 6/2008 |
| JP | 4118929 | B2 | 7/2008 |
| JP | 2008-304729 | A | 12/2008 |

* cited by examiner

*Primary Examiner* — Robert Beatty
(74) *Attorney, Agent, or Firm* — Sughrue Mion, PLLC

(57) ABSTRACT

A cleaning member has a core member that is freely rotatable, a cleaning material that is spirally wound around an outer peripheral surface of the core member, and holding members. The holding members hold end portions of the cleaning material by the end portions being nipped between the holding members and the outer peripheral surface of the core member. An opening is provided in each of the holding members. Each of the openings is continuously open in line with an axial direction of the core member, and the cleaning material is exposed from the openings.

23 Claims, 14 Drawing Sheets

CLEANING MEMBER, CLEANING DEVICE, ASSEMBLY, AND IMAGE FORMING DEVICE

CROSS-REFERENCE TO RELATED APPLICATION

This application is based on and claims priority under 35 USC 119 from Japanese Patent Application No. 2010-005268 filed Jan. 13, 2010.

BACKGROUND

Technical Field

The present invention relates to a cleaning member, a cleaning device, an assembly, and an image forming device.

SUMMARY

According to an aspect of the invention, there is provided a cleaning member including: a core member that is freely rotatable; a cleaning material that is spirally wound around an outer peripheral surface of the core member; and holding members that hold end portions of the cleaning material by the end portions being nipped between the holding members and the outer peripheral surface of the core member, and an opening is provided in each of the holding members, and each of the openings is continuously open in line with an axial direction of the core member, and the cleaning material is exposed from the openings.

BRIEF DESCRIPTION OF THE DRAWINGS

Exemplary embodiments of the present invention will be described in detail based on the following figures, wherein:

FIG. 1 is a front view showing a cleaning member relating to a first exemplary embodiment of the present invention, and the like;

FIG. 10 is a front view showing a cleaning member relating to a second exemplary embodiment of the present invention, and the like;

FIG. 11 is a front view showing a cleaning member relating to a third exemplary embodiment of the present invention, and the like;

FIG. 12 is a front view showing a cleaning member relating to a fourth exemplary embodiment of the present invention, and the like;

DETAILED DESCRIPTION

Figure 1:
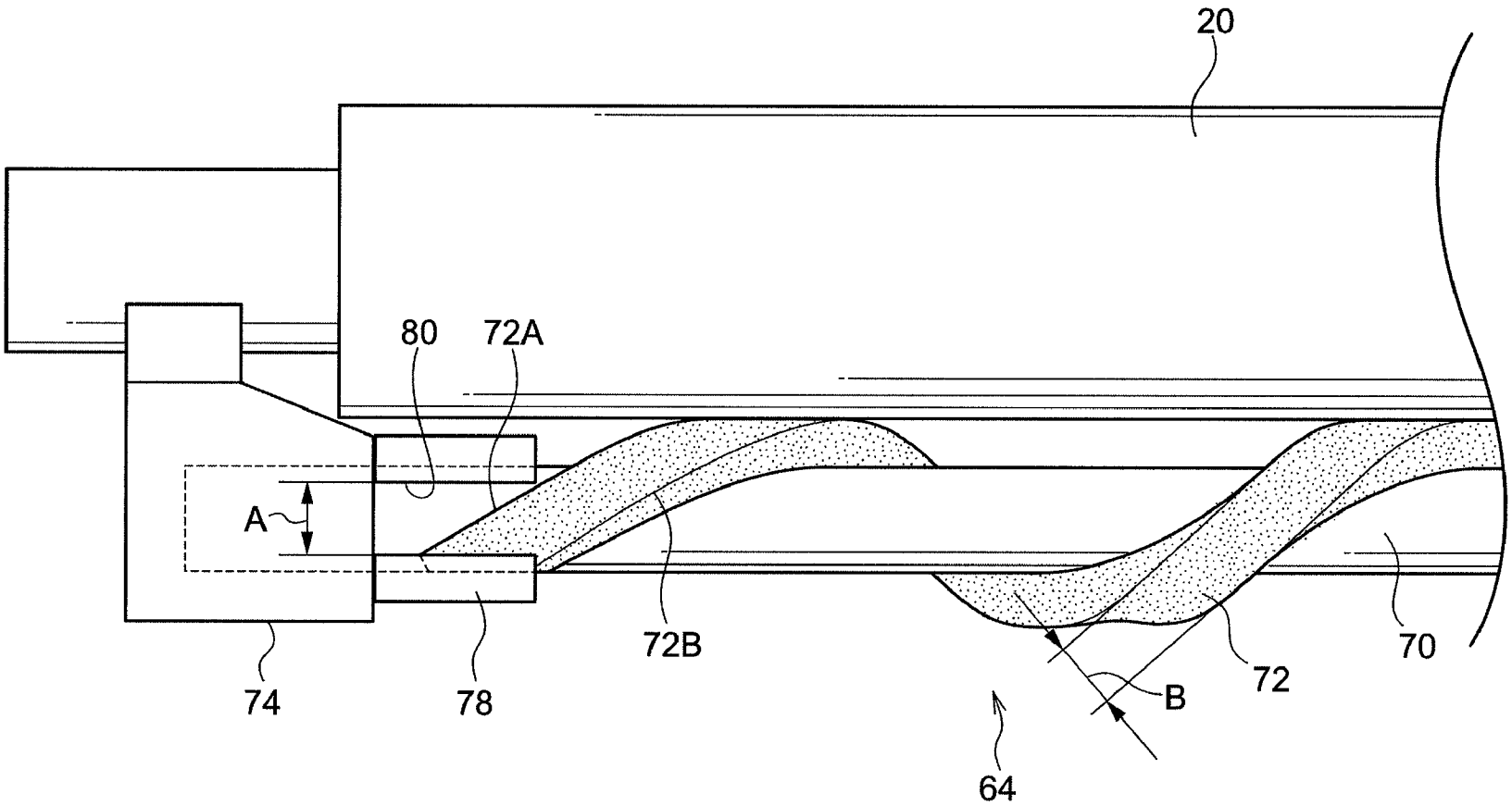

Examples of a cleaning member, a cleaning device, an assembly and an image forming device relating to a first exemplary embodiment of the present invention are described in accordance with FIG. 1 through FIG. 9. Note that arrow UP shown in the drawings indicates the vertically upward direction.

(Overall Structure)

Figure 9:
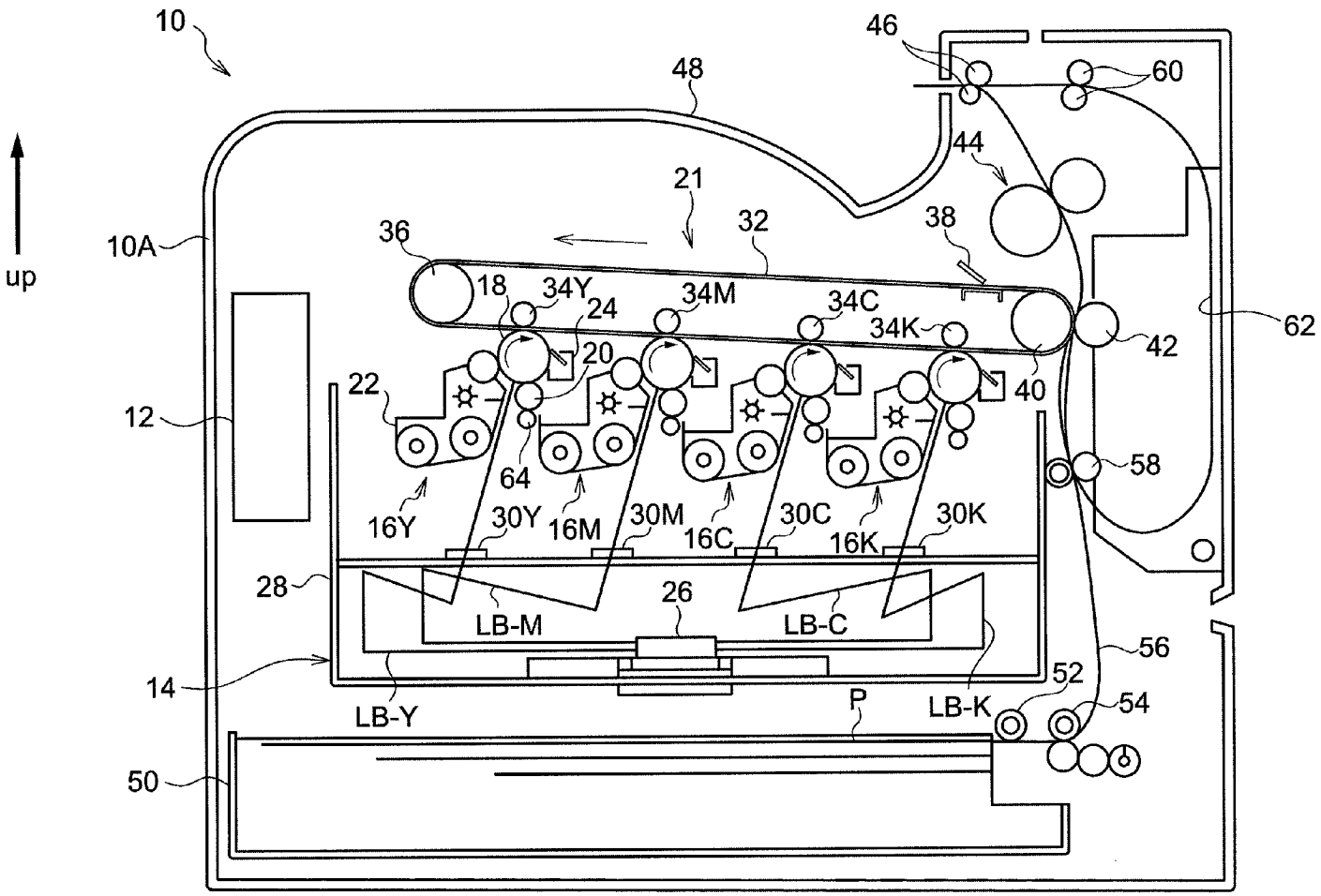
FIG. 9 is a schematic structural drawing showing an image forming device relating to the first exemplary embodiment of the present invention.

As shown in FIG. 9, an image processing section 12, that carries out image processings on inputted image data, is provided within the main body 10A of an image forming device 10.

The image processing section 12 processes inputted image data into gradation data of the four colors of yellow (Y), magenta (M), cyan (C), black (K). An exposure device 14, that receives the processed gradation data and carries out image exposure by laser lights LB, is provided in the center of the main body 10A.

Four image forming units 16Y, 16M, 16C, 16K of yellow (Y), magenta (M), cyan (C), black (K) are disposed at uniform intervals in the horizontal direction, above the exposure device 14. Note that there are cases in which the Y, M, C, K is omitted when there is no need to provide description that differentiates among Y, M, C, K.

These four image forming units 16Y, 16M, 16C, 16K are all structured similarly, and are each structured to include: an image holding body 18 that is shaped as a solid cylinder and is driven to rotate at a predetermined speed; a charging member 20 for primary charging that charges the outer peripheral surface of the image holding body 18; a developing member 22 that develops, by a toner of a predetermined color, an electrostatic latent image formed on the outer peripheral surface of the charged image holding body 18 by the image exposure of the exposure device 14, and makes the image visible as a toner image; and a cleaning blade 24 that cleans the outer peripheral surface of the image holding body 18. A cleaning member 64, that contacts the solid-cylindrical charging member 20 and cleans the outer peripheral surface of the charging member 20, is provided at the lower side of the charging member 20.

A cleaning device 68 is structured by the cleaning member 64 and the charging member 20 that serves as an example of a member to be cleaned that structures the image forming unit 16. A replacement cartridge 66 (see FIG. 2), that serves as an example of an assembly, is structured by the image holding body 18, the charging member 20 and the cleaning member 64. The replacement cartridge 66 may be replaced with respect to the main body 10A. Details of the cleaning member 64 are described hereinbelow.

Four semiconductor lasers, that are not illustrated and that are structured commonly for the four image forming units 16Y, 16M, 16C, 16K, are provided at the exposure device 14. Laser lights LB-Y, LB-M, LB-C, LB-K are emitted from these semiconductor lasers in accordance with gradation data.

The laser lights LB-Y, LB-M, LB-C, LB-K that exit from the semiconductor lasers are illuminated, via unillustrated f-θ lenses, onto a polygon mirror 26 that is a rotating polygon mirror, and are deflected and scanned by the polygon mirror 26. The laser lights LB-Y, LB-M, LB-C, LB-K, that have been deflected and scanned by the polygon mirror 26, are, via imaging lenses and plural mirrors that are not illustrated, scanned and exposed from obliquely downward onto exposure points on the image holding bodies 18.

Because the exposure device 14 scans and exposes images onto the image holding bodies 18 from beneath, there is the concern that toner and the like may drip downward onto the exposure device 14 from the developing members 22 and the like of the four image forming units 16Y, 16M, 16C, 16K that are positioned above. Therefore, the periphery of the exposure device 14 is tightly closed by a parallelepiped frame 28. Windows 30Y, 30M, 30C, 30K, that are formed of transparent glass and that transmit the four laser lights LB-Y, LB-M, LB-C, LB-K toward the image holding bodies 18 of the respective image forming units 16Y, 16M, 16C, 16K, are provided at the top portion of the frame 28.

A primary transfer unit 21 is provided above the respective image forming units 16Y, 16M, 16C, 16K. The primary transfer unit 21 is structured to include: an endless intermediate transfer belt 32; a driving roller 40 around which the intermediate transfer belt 32 is trained, and that is driven and rotated so as to circulate the intermediate transfer belt 32 in the direction of the arrow; a tension imparting roller 36 around which the intermediate transfer belt 32 is trained, and that imparts tension to the intermediate transfer belt 32; a cleaning blade 38 that cleans the outer peripheral surface of the intermediate transfer belt 32; and primary transfer rollers 34Y, 34M, 34C, 34K that are disposed at the opposite sides of the image holding bodies 18Y, 18M, 18C, 18K with the intermediate transfer belt 32 nipped therebetween.

The toner images of the respective colors of yellow (Y), magenta (M), cyan (C), black (K), that have been successively formed on the image holding bodies 18 of the image forming units 16Y, 16M, 16C, 16K, are transferred onto the intermediate transfer belt 32 so as to be superposed one on another by the four primary transfer rollers 34Y, 34M, 34C, 34K.

A secondary transfer roller 42 is provided at the opposite side of the driving roller 40, with the intermediate transfer belt 32 nipped therebetween. The toner images of the respective colors of yellow (Y), magenta (M), cyan (C), black (K), that have been transferred onto the intermediate transfer belt 32 so as to be superposed one on another, are conveyed by the intermediate transfer belt 32, are nipped by the driving roller 40 and the secondary transfer roller 42, and are secondarily-transferred onto a sheet member P that serves as a recording medium and that is conveyed along a sheet conveying path 56.

A fixing device 44 that fixes the toner image, that has been transferred on the sheet member P, onto the sheet member P by heat and pressure, is provided at the sheet member P conveying direction downstream side (hereinafter simply called downstream side) of the secondary transfer roller 42.

Ejecting rollers 46 are provided at the downstream side of the fixing device 44. The ejecting rollers 46 eject the sheet member P, on which the toner image has been fixed, out to an ejecting section 48 that is provided at the top portion of the main body 10A of the image forming device 10.

A sheet feeding member 50 in which the sheet members P are stacked is provided at the lower side of the interior of the main body 10A of the image forming device 10. A sheet feeding roller 52 that conveys the sheet member P, that is stacked in the sheet feeding member 50, out to the sheet conveying path 56 is provided. A separating roller 54, that separates the sheet members P one-by-one and conveys the sheet member P, is provided at the downstream side of the sheet feeding roller 52. An aligning roller 58, that adjusts the conveying timing, is provided at the downstream side of the separating roller 54. Due thereto, the sheet member P, that is supplied from the sheet feeding member 50, is sent-out to the position at which the intermediate transfer belt 32 and the secondary transfer roller 42 contact one another (a secondary transfer position) by the aligning roller 58 that rotates at a predetermined timing.

Conveying rollers 60 are provided next to the ejecting rollers 46. The conveying rollers 60 convey the sheet member P, on whose one side an image has been fixed by the fixing device 44, to a conveying path 62 for double-sided printing, without the sheet member P being ejected as is out onto the ejecting section 48 by the ejecting rollers 46. Due thereto, the sheet member P that is conveyed along the conveying path 62 for double-sided printing is, in a state in which the obverse and reverse thereof are inverted, again conveyed to the aligning roller 58. This time, a toner image is transferred and fixed onto the reverse of the sheet member P, and the sheet member P is ejected onto the ejecting section 48.

Due to this structure, an image is formed on the sheet member P as follows.

Gradation data of the respective colors is successively outputted from the image processing section 12 to the exposure device 14. The laser lights LB-Y, LB-M, LB-C, LB-K, that are emitted from the exposure device 14 in accordance with the gradation data, are scanned and exposed onto the outer peripheral surface of the image holding bodies 18 that have been charged by the charging members 20, such that electrostatic latent images are formed on the outer peripheral surfaces of the image holding bodies 18. The electrostatic latent images formed on the image holding bodies 18 are made visible as toner images of the respective colors of yellow (Y), magenta (M), cyan (C), black (K) respectively by the developing members 22Y, 22M, 22C, 22K.

The toner images of the respective colors of yellow (Y), magenta (M), cyan (C), black (K) that are formed on the image holding bodies 18 are transferred in a superposed manner onto the intermediate transfer belt 32 that circulates, by the primary transfer rollers 34 of the primary transfer unit 21 that is disposed over the region above the respective image forming units 16Y, 16M, 16C, 16K.

The toner images of the respective colors, that have been transferred in a superposed manner onto the intermediate transfer belt 32 that circulates, are secondarily-transferred, by the secondary transfer roller 42, onto the sheet member P that is conveyed at a predetermined timing from the sheet feeding member 50 to the sheet conveying path 56 by the sheet feeding roller 52, the separating roller 54 and the aligning roller 58.

The sheet member P, on which the toner images have been transferred, is conveyed to the fixing device 44. The toner images transferred on the sheet member P are fixed to the sheet member P by the fixing device 44. After fixing, the sheet member P is ejected by the ejecting rollers 46 to the ejecting section 48 that is provided at the top portion of the main body 10A of the image forming device 10.

If images are to be formed on both sides of the sheet member P, the conveying direction of the sheet member P, on whose one surface an image has been fixed by the fixing device 44, is switched without the sheet member P being ejected as is onto the ejecting section 48 by the ejecting rollers 46, and the sheet member P is conveyed via the conveying rollers 60 to the conveying path 62 for double-sided printing. Due to the sheet member P being conveyed along the conveying path 62 for double-sided printing, the obverse and the reverse of the sheet member P are inverted, and the sheet member P is again conveyed to the aligning roller 58. This time, toner images are transferred and fixed onto the reverse of the sheet member P. After the transferring and fixing, the sheet member P is ejected by the ejecting rollers 46 onto the ejecting section 48.

(Structure of Main Portions)

The cleaning member 64, that cleans the outer peripheral surface of the solid-cylindrical charging member 20, is described.

Figure 2:
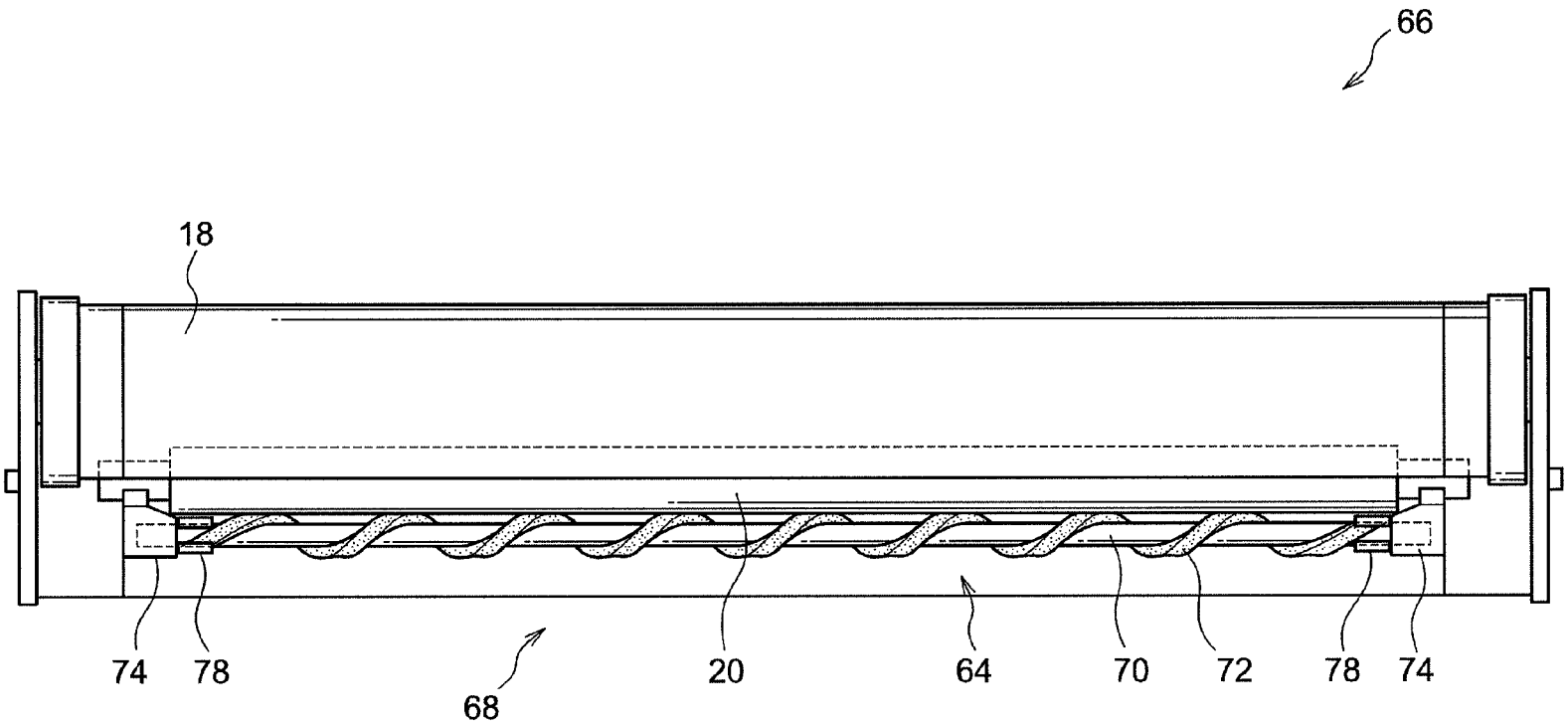
FIG. 2 is a front view showing the cleaning member, a cleaning device, and a replacement cartridge relating to the first exemplary embodiment of the present invention.

As shown in FIG. 1 and FIG. 2, the cleaning member 64, that extends along the axial direction of the charging member 20 (hereinafter simply called axial direction), is provided so as to face the charging member 20. The cleaning member 64 has a core member 70 that is solid-cylindrical and extends in the axial direction, and a cleaning material 72 that is rectangular in sectional view and is spirally wound around the core member 70. In the present exemplary embodiment, the cleaning material 72 is, as an example, formed by a foam material of urethane resin that is elastically deformable. The cleaning material 72 is fixed to the outer peripheral surface of the core member 70 by using double-sided tape (not shown).

Both ends of the core member 70 are supported by bearing members 74 that freely rotatably support the core member 70 from the outer sides. The bearing members 74 support the cleaning member 64 at a position such that the cleaning material 72 contacts the outer peripheral surface of the charging member 20 in a state of being compressed by a predetermined amount. Due to this structure, the cleaning member 64 is slave-rotated accompanying the rotation of the charging member 20.

At the general portion of the cleaning member 64 that is not held by holding members 78 that will be described later, a ridgeline 72A and a ridgeline 72B of the cleaning material 72 (the intersecting lines of a surface and a surface that structure the outer periphery of the cleaning material 72) project-out in the radial direction of the core member 70 (hereinafter simply called radial direction).

As shown in FIG. 1, the holding members 78 are provided at the end portions of the cleaning material 72. The holding members 78 are tubular, and nip the end portions of the cleaning material 72 between the holding members 78 and the core member 70, and prevent the end portions of the cleaning material 72 from peeling-off from the core member 70.

In more detail, in the present exemplary embodiment, the holding members 78 are molded of, for example, a resin material, and each have an opening 80 that is continuously open from one axial direction end to the other end. The openings 80 formed in the holding members 78 are provided along the axial direction, and the dimension of the opening width of the openings 80 (dimension A shown in FIG. 1) is constant. The dimension of the opening width of the openings 80 (the dimension A shown in FIG. 1) is equal to the dimension of the width of the cleaning material 72 (dimension B shown in FIG. 1) or is wider than the dimension of the width of the cleaning material 72.

Figure 8:
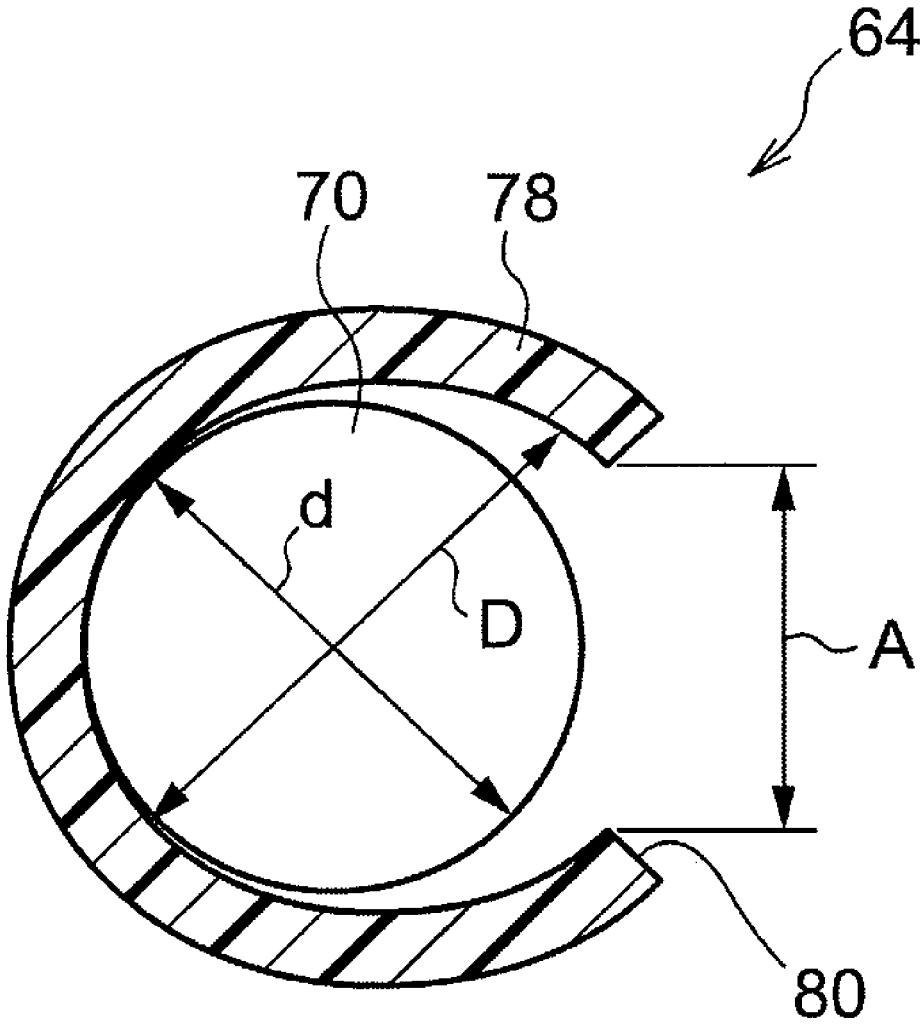
FIG. 8 is a side view showing a holding member and a core member that are employed in the cleaning member relating to the first exemplary embodiment of the present invention.

As shown in FIG. 8, given that the diameter of the core member 70 is d and the inner diameter of the holding member 78 in the free state is D, these respective diameters are determined such that $d<D$. Further, given that the dimension of the opening width of the opening 80 is A, the respective shapes are determined such that $A<d$. Due thereto, the workability of assembling the holding members 78 to the core member 70 is ensured.

Figure 3A:
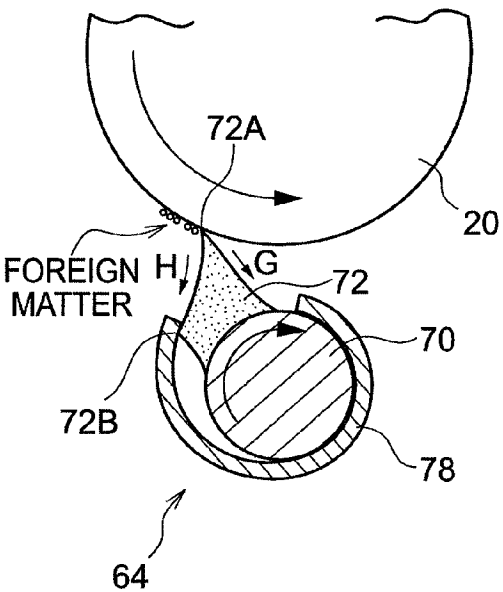
FIGS. 3A, 3B and 3C are side views showing the cleaning member and the cleaning device relating to the first exemplary embodiment of the present invention.

As shown in FIG. 1, the cleaning material 72 is held by the holding member 78 such that the ridgeline 72A of the cleaning material 72 (the ridgeline 72A that abuts the charging member 20 first when the cleaning member 64 is slave-rotated) is exposed from the opening 80, and the ridgeline 72A of the cleaning material 72 projects-out in the radial direction. In more detail, as shown in FIG. 3A, due to the ridgeline 72A being exposed, the ridgeline 72A side end portion of the cleaning material 72 projects-out in the radial direction, in the cross-section that is orthogonal to the longitudinal direction of the cleaning material 72. The height of the end portion that projects-out is the same height as the height (see FIG. 4A) of the general portion that is not held by the holding members 78.

Note that, in FIGS. 3A through 3C and FIGS. 4A through 4C, the radial direction dimension of the cleaning material 72 is drawn in an exaggerated manner for easier understanding of the radial direction deformation of the cleaning material 72.

Figure 5A:
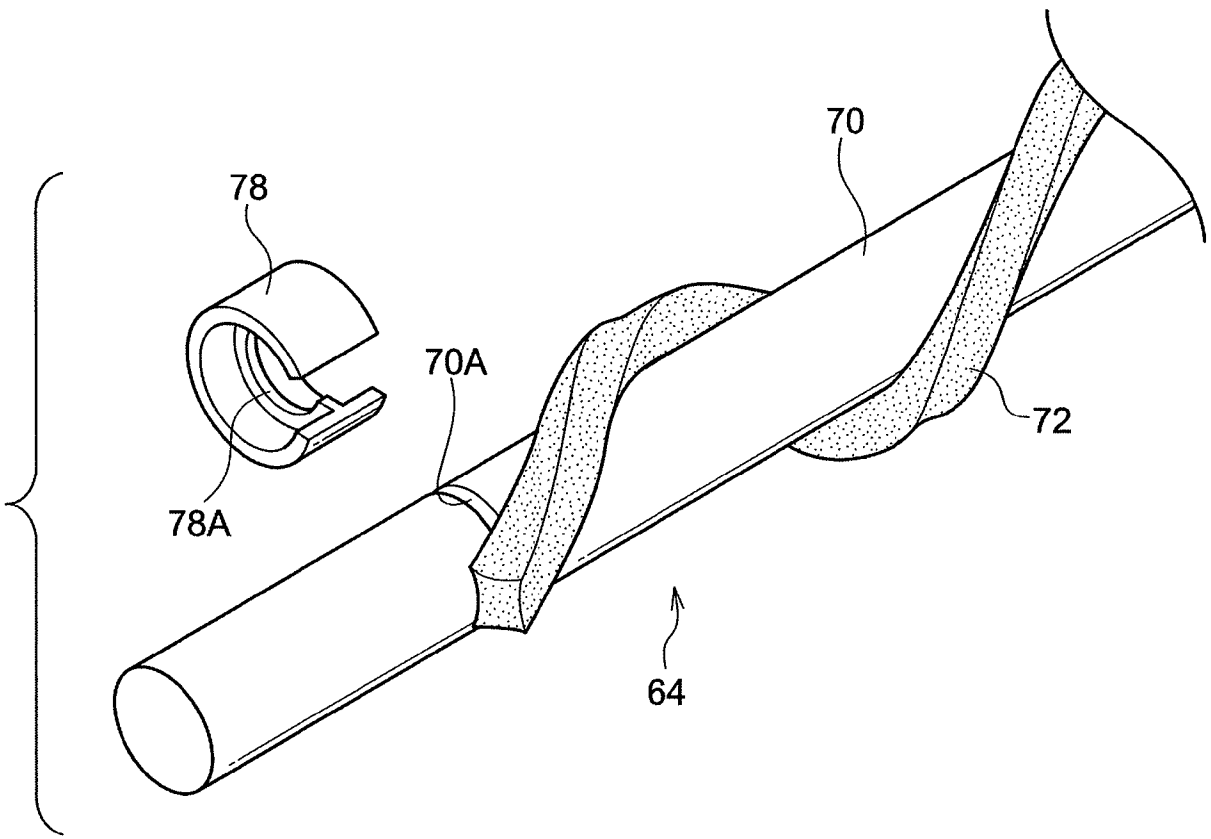
FIGS. 5A and 5B are perspective views showing the cleaning member relating to the first exemplary embodiment of the present invention.
Figure 5B:
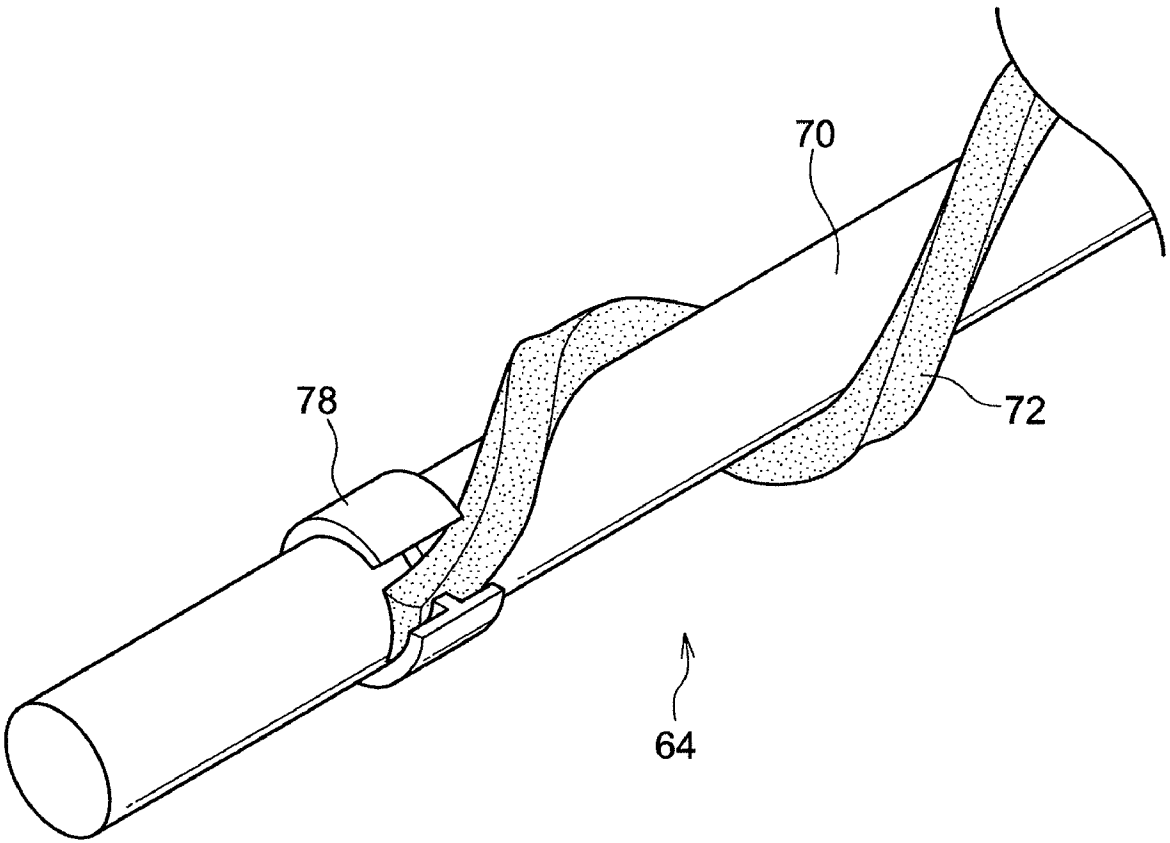

As shown in FIGS. 5A and 5B, a core concave portion 70A that is concave is provided along the peripheral direction at the outer peripheral surface of the core member 70. A holding convex portion 78A, that is convex and that meshes-together with the core concave portion 70A when the holding member 78 is held at the core member 70, is provided at the inner peripheral surface of the holding member 78.

(Operation)

As shown in FIG. 9, the toner images, that are formed on the outer peripheral surfaces of the image holding bodies 18 that rotate, are transferred onto the intermediate transfer belt 32 that circulates. Further, foreign matter, such as the toner remaining on the outer peripheral surfaces of the image holding bodies 18 without being transferred onto the intermediate transfer belt 32, and the like, is removed from the outer peripheral surfaces of the image holding bodies 18 by the cleaning blades 24.

Foreign matter, such as external additives that are included in the developers and whose particle diameters are small, and the like, slips-past the cleaning blades 24. The foreign matter, such as external additives and the like that slips-past the cleaning blades 24, adheres to the outer peripheral surfaces of the charging members 20.

Figure 4A:
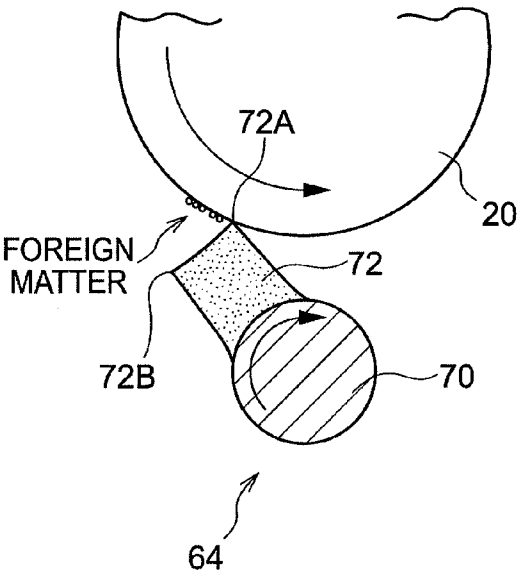
FIGS. 4A, 4B and 4C are side views showing the cleaning member and the cleaning device relating to the first exemplary embodiment of the present invention.
Figure 4B:
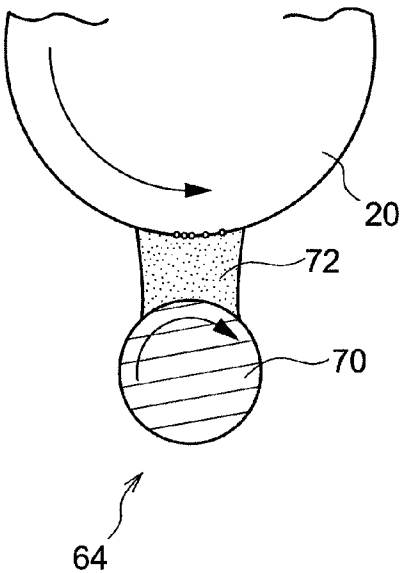
Figure 4C:
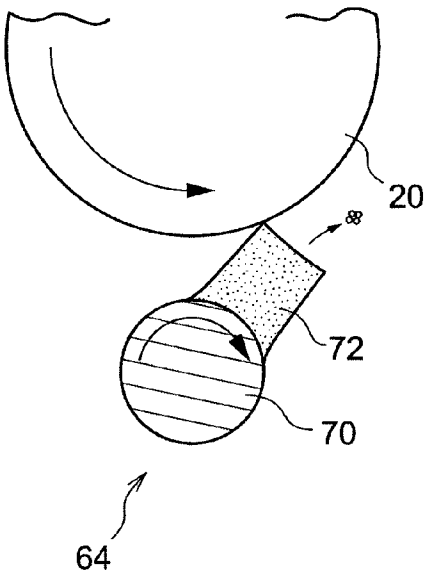

As shown in FIGS. 4A and 4B, at the general portion of the cleaning material 72 that is not held by the holding members 78, the foreign matter, such as external additives and the like that has adhered to the outer peripheral surface of the charging member 20 that rotates in the direction of the arrow, is pressed and cohered by the cleaning material 72 due to the cleaning material 72 of the cleaning member 64 that is slave-rotated being pressed by the outer peripheral surface of the charging member 20 and elastically deforming. As shown in FIG. 4C, the cleaning material 72 of the cleaning member 64 that is slave-rotated is restored, and due to this restoring force, the cohered foreign matter such as external additives and the like is loosened from the dense state and is repelled from the outer peripheral surface of the charging member 20.

Figure 3B:
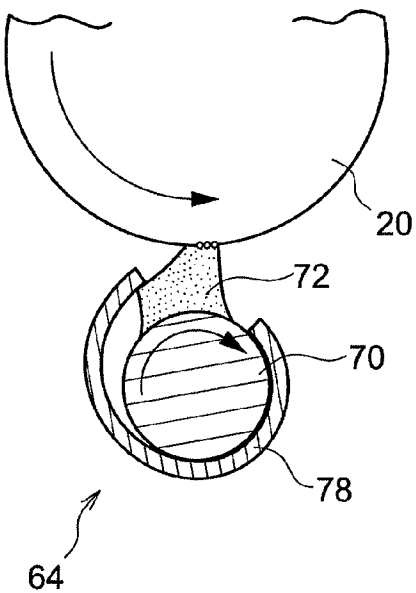
Figure 3C:
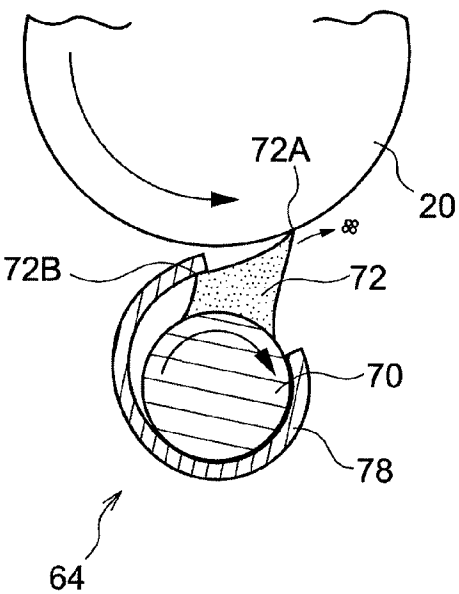

As shown in FIGS. 3A and 3B, at the end portion of the cleaning material 72 that is held at the holding member 78, the foreign matter, such as external additives and the like that has adhered to the outer peripheral surface of the charging member 20 that rotates, is pressed and cohered by the cleaning material 72 due to the ridgeline 72A side end portion of the cleaning material 72 of the cleaning member 64 that is slave-rotated being pressed by the outer peripheral surface of the charging member 20 and elastically deforming (elastically compressing) in the heightwise direction (direction G shown in FIG. 3A) and the widthwise direction (direction H shown in FIG. 3A) of the cleaning member 64. As shown in FIG. 3C, the ridgeline 72A side end portion of the cleaning material 72 of the cleaning member 64 that is slave-rotated is restored, and due to this restoring force, the cohered foreign matter such as external additives and the like is loosened from the dense state and is repelled from the outer peripheral surface of the charging member 20.

The radial direction height of the ridgeline 72A side end portion of the cleaning material 72 shown in FIG. 3A is investigated in comparison with comparative examples.

Figure 7A:
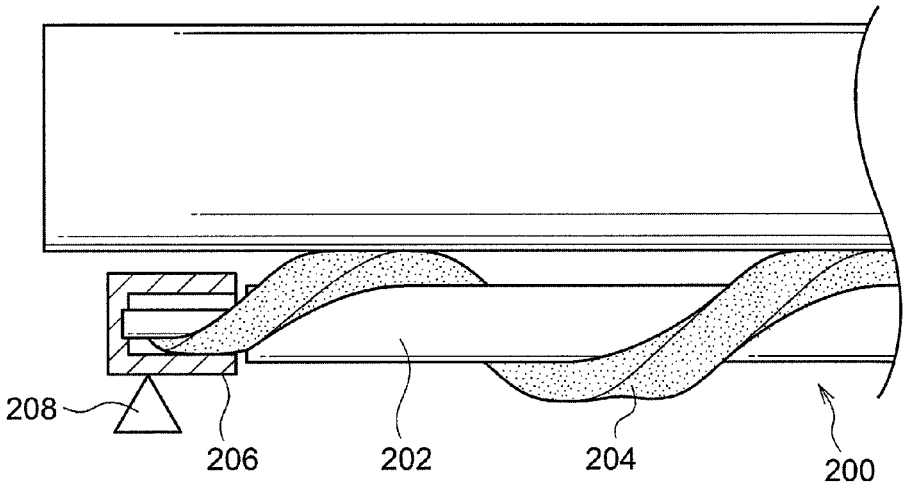
FIGS. 7A and 7B are front views showing a conventional cleaning member that is shown as a comparative example for comparison with the cleaning member relating to the first exemplary embodiment of the present invention.

A cleaning member 200 of a first comparative example is shown in FIG. 7A. As shown in FIG. 7A, the end portion of a cleaning material 204, that is spirally wound around a core member 202 of the cleaning member 200 of the first comparative example, is held by being inserted in a holding member 206 that is cup-shaped. The holding member 206 is supported so as to be freely rotatable at a bearing member 208.

Figure 7B:
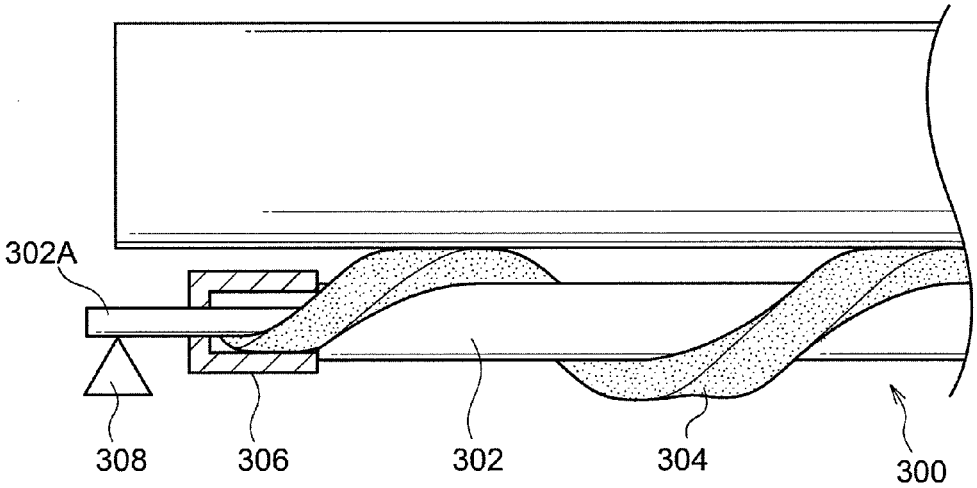

A cleaning member 300 of a second comparative example is shown in FIG. 7B. As shown in FIG. 7B, the end portion of a cleaning material 304, that is spirally wound around a core member 302 of the cleaning member 300 of the second comparative example, is held by being inserted in a holding member 306 that is cup-shaped. A projecting portion 302A of the core member 302, that projects-out from the floor plate of the holding member 306, is supported so as to be freely rotatable at a bearing member 308.

Figure 6:
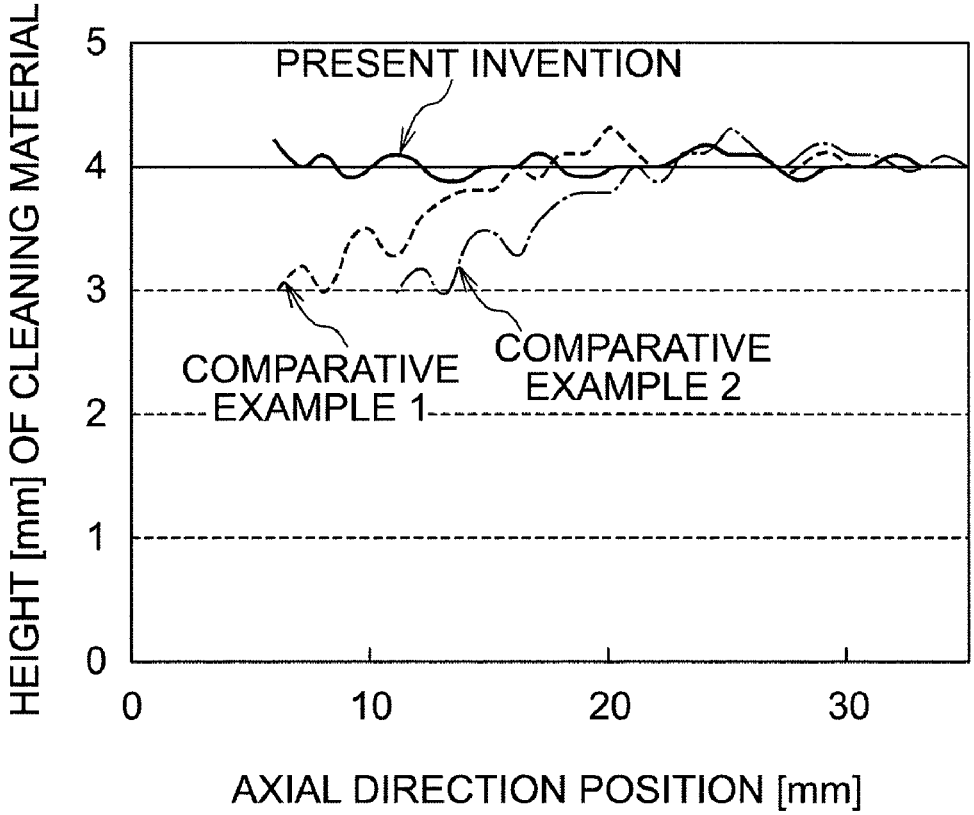
FIG. 6 is a diagram showing the height of a cleaning material that is employed at the cleaning member relating to the first exemplary embodiment of the present invention.

FIG. 6 shows a graph in which the height of the cleaning material from the axial center of the core member is plotted on the vertical axis, and the axial direction position of the cleaning material is plotted on the horizontal axis. Note that, on the horizontal axis, nearing the origin means nearing the end portion of the core member.

In the first comparative example and the second comparative example (see FIGS. 7A and 7B) in which the end portion of the cleaning material 204, 304 is inserted and held within the cup-shaped holding member 206, 306, the height of the end portion of the cleaning material 204, 304 is lower than the height of the general portion.

In contrast, as may be understood from this graph, in the structure of the present exemplary embodiment, the ridgeline 72A of the cleaning material 72 is exposed from the opening 80 of the holding member 78. Therefore, it may be understood that, even at the end portion of the cleaning material 72 that is held by the holding member 78, a height that is equivalent to that of the general portion is ensured.

As described above, by exposing the ridgeline 72A of the cleaning material 72 from the opening 80 of the holding member 78, a height that is equivalent to that of the general portion is ensured even at the end portion of the cleaning material 72. Due thereto, when the cleaning member 64 is slave-rotated accompanying the rotation of the charging member 20, due to the end portion of the cleaning material 72 being pressed by the charging member 20 and elastically deforming in the aforementioned heightwise direction and widthwise direction and being restored, the foreign matter that has adhered to the charging member 20 is repelled from the outer peripheral surface of the charging member 20, as compared with a case in which the cleaning material elastically deforms only in the heightwise direction.

Due to the foreign matter that has adhered to the charging member 20 being repelled from the outer peripheral surface of the charging member 20 even at the end portions of the cleaning material 72, the cleaning performance at the end portions of the cleaning material 72, that is spirally wound on the core member 70, is improved as compared with the comparative examples.

Due to the cleaning performance at the end portions of the cleaning material 72 improving, the outer peripheral surface of the charging member 20 to which foreign matter and the like adhere is effectively cleaned along the entire range in the axial direction at which the cleaning material 72 is disposed.

Due to the cleaning performance at the end portions of the cleaning material 72 improving, the image forming device 10 may be made to be compact in the axial direction, as compared with cases in which an equivalent cleaning performance is obtained by the structures of the comparative examples of FIGS. 7A and 7B.

The opening 80 formed in the holding member 78 is continuously open from one axial direction end to the other end. Therefore, the workability of assembling the holding member 78 to the core member 70 improves.

The core concave portion 70A is provided at the outer peripheral surface of the core member 70, and the holding convex portion 78A that meshes-together with the core concave portion 70A is provided at the inner peripheral surface of the holding member 78. Axial direction movement of the holding member 78 with respect to the core member 70 is thereby restricted.

Due to foreign matter such as external additives and the like, that have adhered to the outer peripheral surface of the charging member 20, being repelled (removed) by the cleaning member 64, poor charging of the image holding body 18 is suppressed. Therefore, the quality of the toner image formed on the image holding body 18 improves.

Due to the quality of the toner image formed on the image holding body 18 improving, the quality of the outputted image that is formed on the sheet member P improves.

The present invention is described in detail with reference to a specific exemplary embodiment, but the present invention is not limited to the exemplary embodiment, and it will be clear to those skilled in the art that various other exemplary embodiments are possible within the scope of the present invention. For example, in the above-described exemplary embodiment, the foreign matter such as external additives and the like, that has adhered to the outer peripheral surface of the charging member 20 that serves as the member to be cleaned, is removed by using the cleaning member 64. However, the present invention is not particularly limited to the charging member 20. For example, foreign matter such as paper powder, toner, external additives and the like that has adhered to any of the image holding body, a transfer belt and a transfer roller, or foreign matter such as toner, external additives and the like that has adhered to any of the intermediate transfer belt and an intermediate transfer roller, may be removed by the cleaning member 64.

In the above-described exemplary embodiment, a foamed material of urethane resin that is elastically deformable is used as the material of the cleaning material 72. However, the material is not particularly limited to the same, and another material such as a foamed material of a rubber material, a brush, non-woven fabric, or the like may be used.

In the above-described exemplary embodiment, a resin material is used as the material of the holding member 78. However, the material is not particularly limited to the same, and another material such as an elastic body (rubber), metal, or the like may be used.

In the above-described exemplary embodiment, the core concave portion 70A is provided at the outer peripheral surface of the core member 70, and the holding convex portion 78A that meshes-together with the core concave portion 70A is provided at the inner peripheral surface of the holding member 78. However, a convex portion may be provided at the outer peripheral surface of the core member, and a concave portion may be provided at the inner peripheral surface of the holding member 78.

In the above-described exemplary embodiment, the replacement cartridge 66 is structured by the image holding body 18, the charging member 20 and the cleaning member 64. However, other members, such as the developing member and the like, may be added as structural parts of the replacement cartridge 66.

Figure 10:
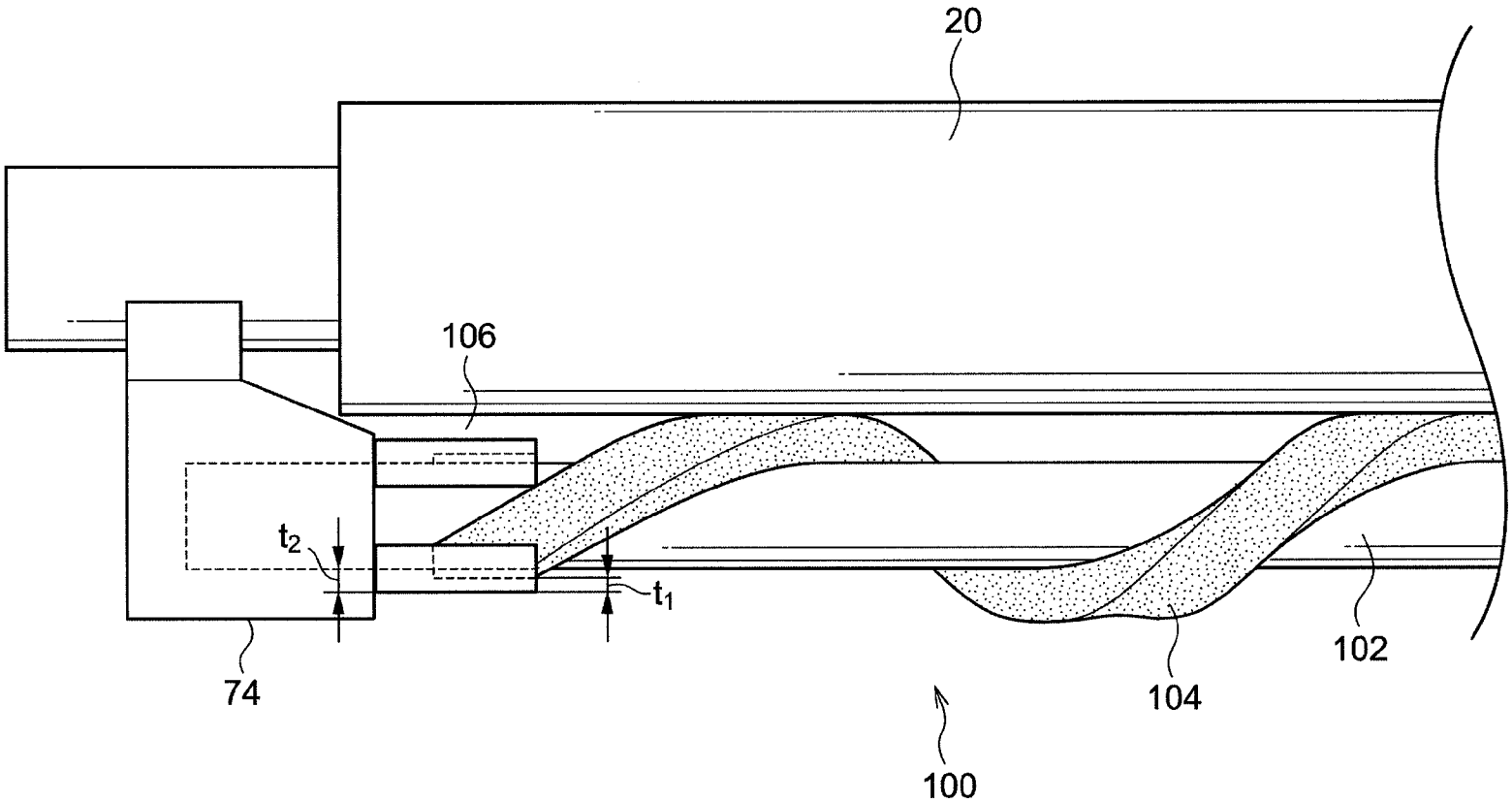

An example of a cleaning member relating to a second exemplary embodiment of the present invention is described in accordance with FIG. 10. Note that members that are the same as those of the first exemplary embodiment are denoted by the same reference numerals, and description thereof is omitted.

As shown in FIG. 10, the wall thickness of a holding member 106, that holds the end portion of a cleaning material 104 that is spirally wound around a core member 102 of a cleaning member 100 of the second exemplary embodiment, is thicker at the axial direction end portion of the core member 102 than at the central side thereof ($t_1<t_2$).

By making the wall thickness of the holding member 106 thicker at the axial direction end portion in this way, the rigidity of the holding member 106 at the axial direction end portion is higher, and the final end portion of the cleaning material 104 is held efficiently.

An example of a cleaning member relating to a third exemplary embodiment of the present invention is described next in accordance with FIG. 11. Note that members that are the same as those of the first exemplary embodiment are denoted by the same reference numerals, and description thereof is omitted.

Figure 11:
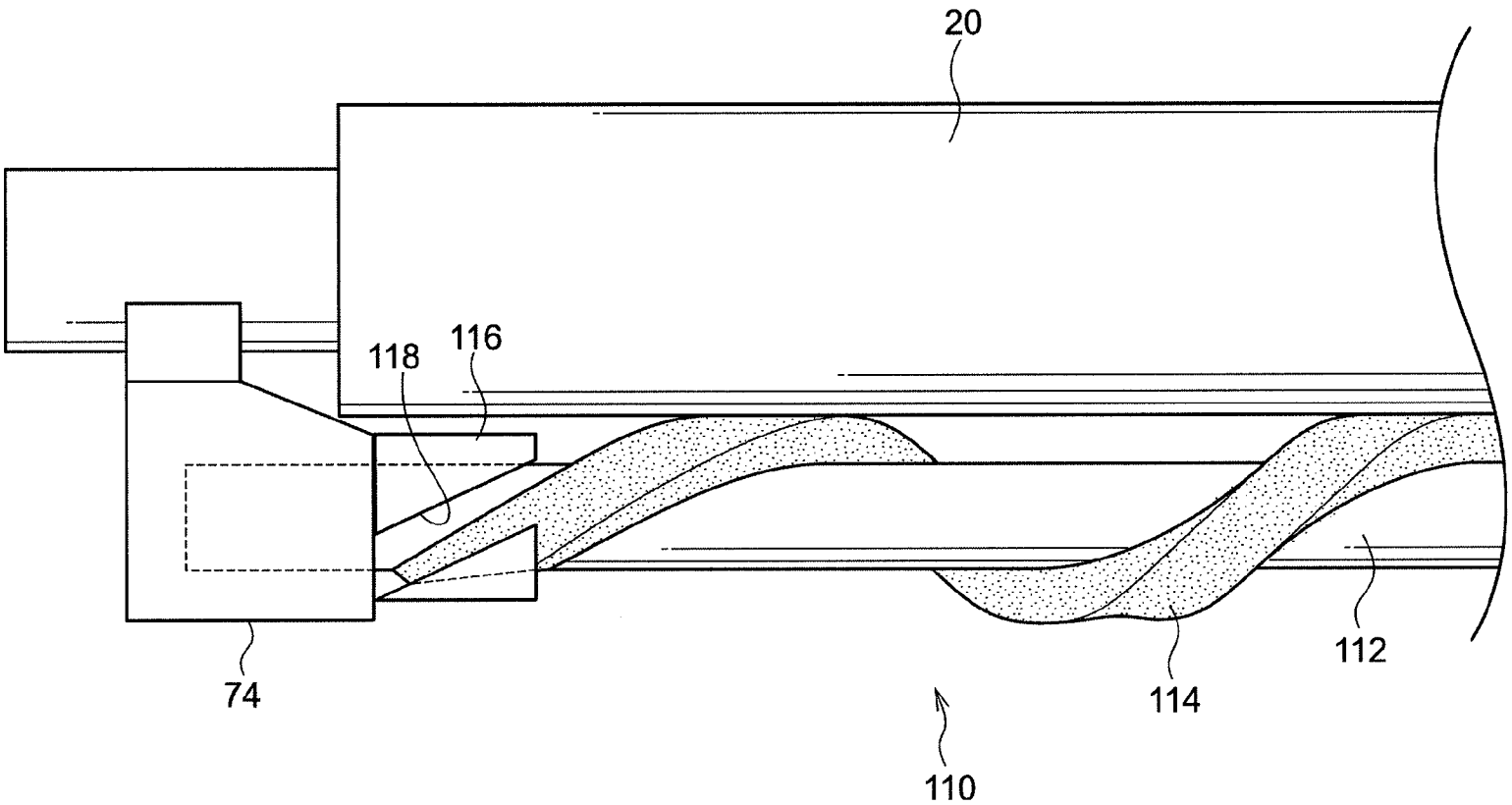

As shown in FIG. 11, an opening 118 of a holding member 116, that holds the end portion of a cleaning material 114 that is spirally wound around a core member 112 of a cleaning member 110 of the third exemplary embodiment, is provided along the portion of the cleaning material 114 nipped by the holding member 116. The dimension of the opening width of the opening 118 formed in the holding member 116 is equal to the dimension of the width of the cleaning material 114 or wider than the dimension of the width of the cleaning material 114.

Due thereto, the cleaning performance at the end portion of the cleaning material 114 improves, regardless of the angle at which the cleaning material 114 is wound.

Figure 12:
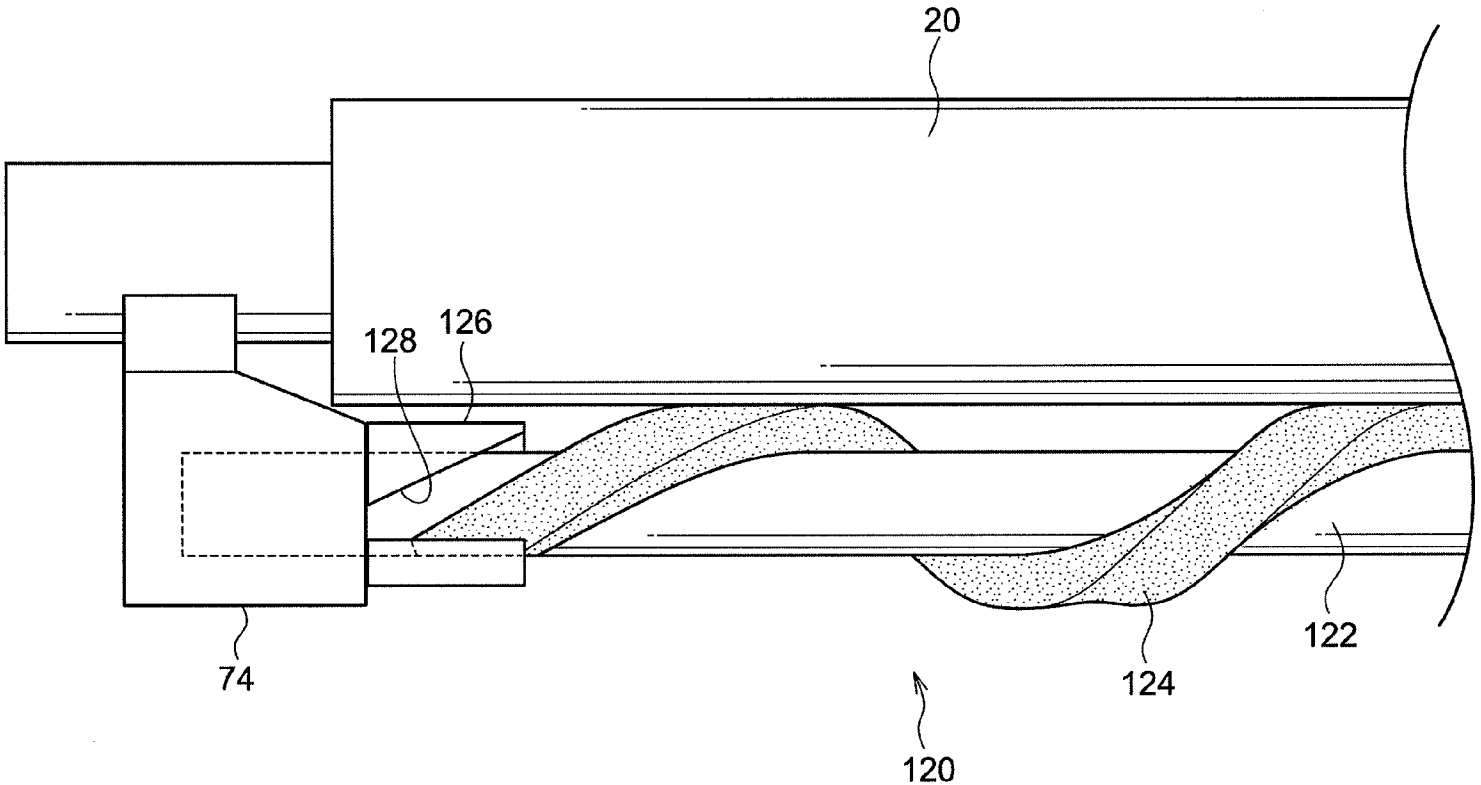

An example of a cleaning member relating to a fourth exemplary embodiment of the present invention is described in accordance with FIG. 12. Note that members that are the same as those of the first exemplary embodiment are denoted by the same reference numerals, and description thereof is omitted.

As shown in FIG. 12, an opening 128 of a holding member 126, that holds the end portion of a cleaning material 124 that is spirally wound around a core member 122 of a cleaning member 120 of the fourth exemplary embodiment, widens toward the axial direction center of the core member 122.

Due to the opening 128 of the holding member 126 becoming wider toward the axial direction center of the core member 122 in this way, the length of the cleaning material 124 that is held by the holding member 126 is longer than in the first exemplary embodiment, and the end portion of the cleaning material 124 is held efficiently.

Figure 13A:
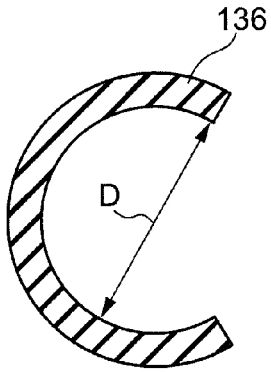
FIGS. 13A and 13B are front views showing a holding member and a core member that are employed in a cleaning member relating to a fifth exemplary embodiment of the present invention.
Figure 13B:
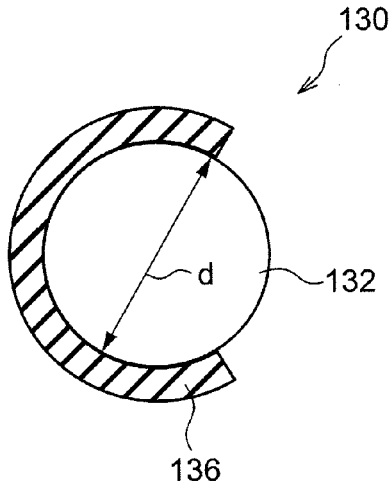

An example of a cleaning member relating to a fifth exemplary embodiment of the present invention is described in accordance with FIGS. 13A and 13B. Note that members that are the same as those of the first exemplary embodiment are denoted by the same reference numerals, and description thereof is omitted.

As shown in FIGS. 13A and 13B, a holding member 136, that holds the end portion of a cleaning material (not shown) that is spirally wound around a core member 132 of a cleaning member 130 of the fifth exemplary embodiment, is molded of a rubber material. Given that the inner diameter of the holding member 136 before mounting is D and the outer diameter of the core member 132 is d, $d \geqq D$.

Due thereto, the end portion of the cleaning material is held by using the urging force of the holding member 136 that is held at the core member 132.

Figure 14A:
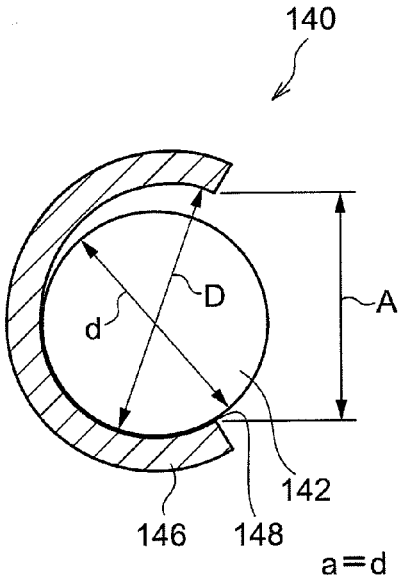
FIGS. 14A and 14B are a front view and a side view showing a holding member and a core member that are employed in a cleaning member relating to a sixth exemplary embodiment of the present invention.
Figure 14B:
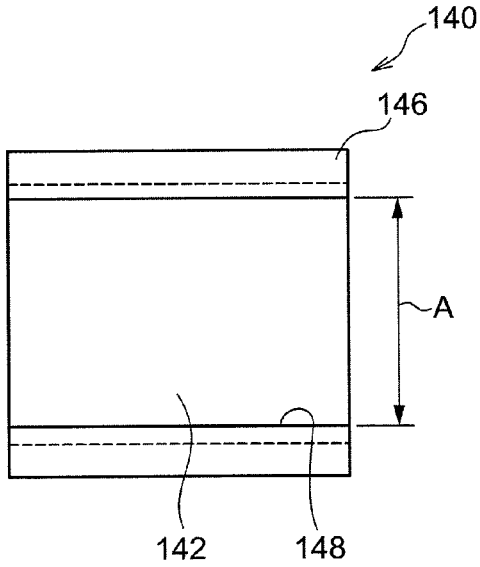

An example of a cleaning member relating to a sixth exemplary embodiment of the present invention is described in accordance with FIGS. 14A and 14B. Note that members that are the same as those of the first exemplary embodiment are denoted by the same reference numerals, and description thereof is omitted.

As shown in FIG. 14A and FIG. 14B, a holding member 146, that holds the end portion of a cleaning material (not shown) that is spirally wound around a core member 142 of a cleaning member 140 of the sixth exemplary embodiment, is molded of a metal. Given that the inner diameter of the holding member 146 is D and the outer diameter of the core member 142 is d, $d<D$. Given that the opening width of an opening 148 of the holding member 146 is A, $A \approx d$.

Due thereto, the end portion of the cleaning material is held by using the gap between the core member 142 and the holding member 146.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to be suited to the particular use contemplated. It is intended that the scope of the invention be defined by the following claims and their equivalents.

What is claimed is:

1. A cleaning member comprising:

a core member that is freely rotatable;

a cleaning material that is spirally wound around an outer peripheral surface of the core member; and holding members that hold end portions of the cleaning material by the end portions being nipped between the holding members and the outer peripheral surface of the core member, and an opening is provided in each of the holding members, and each of the openings is continuously open in line with an axial direction of the core member, and the cleaning material is exposed from the openings.

2. The cleaning member of claim 1, wherein the cleaning material is shaped as an elongated strip, and a cross-section of the cleaning material orthogonal to a longitudinal direction is rectangular, and one ridgeline of the cleaning material is exposed from the openings.

3. The cleaning member of claim 1, wherein the openings are provided along directions of winding of portions of the cleaning material which portions are nipped by the holding members.

4. The cleaning member of claim 1, wherein a dimension of an opening width of each of the openings is equal to a dimension of a width of the cleaning material or is wider than the dimension of the width of the cleaning material.

5. The cleaning member of claim 1, wherein an opening width of each of the openings becomes wider toward an axial direction center of the core member.

6. The cleaning member of claim 1, wherein a wall thickness of the holding members is thicker at an axial direction end portion of the core member than at a central side.

7. The cleaning member of claim 1, wherein core convex portions or core concave portions are provided at an outer peripheral surface of the core member, and holding concave portions or holding convex portions, that mesh-together with the core convex portions or the core concave portions, are provided at inner peripheral surfaces of the holding members.

8. A cleaning device comprising:

a member to be cleaned that circulates or rotates; and the cleaning member of claim 1 that contacts the member to be cleaned and is slave-rotated accompanying circulation or rotation of the member to be cleaned.

9. The cleaning device of claim 8, wherein the cleaning material is shaped as an elongated strip, and a cross-section of the cleaning material orthogonal to a longitudinal direction is rectangular, and one ridgeline of the cleaning material is exposed from the openings.

10. The cleaning device of claim 8, wherein the openings are provided along directions of winding of portions of the cleaning material which portions are nipped by the holding members.

11. The cleaning device of claim 8, wherein a dimension of an opening width of each of the openings is equal to a dimension of a width of the cleaning material or is wider than the dimension of the width of the cleaning material.

12. The cleaning device of claim 8, wherein an opening width of each of the openings becomes wider toward an axial direction center of the core member.

13. The cleaning device of claim 8, wherein a wall thickness of the holding members is thicker at an axial direction end portion of the core member than at a central side.

14. The cleaning device of claim 8, wherein core convex portions or core concave portions are provided at an outer peripheral surface of the core member, and holding concave portions or holding convex portions, that mesh-together with the core convex portions or the core concave portions, are provided at inner peripheral surfaces of the holding members.

15. An assembly that is replaceably assembled with respect to a main body, the assembly comprising:

an image holding body;

a charging member that rotates and that charges an outer peripheral surface of the image holding body; and the cleaning member of claim 1 that contacts the charging member and is slave-rotated accompanying rotation of the charging member.

16. The assembly of claim 15, wherein the cleaning material is shaped as an elongated strip, and a cross-section of the cleaning material orthogonal to a longitudinal direction is rectangular, and one ridgeline of the cleaning material is exposed from the openings.

17. The assembly of claim 15, wherein the openings are provided along directions of winding of portions of the cleaning material which portions are nipped by the holding members.

18. The assembly of claim 15, wherein a dimension of an opening width of each of the openings is equal to a dimension of a width of the cleaning material or is wider than the dimension of the width of the cleaning material.

19. The assembly of claim 15, wherein an opening width of each of the openings becomes wider toward an axial direction center of the core member.

20. The assembly of claim 15, wherein a wall thickness of the holding members is thicker at an axial direction end portion of the core member than at a central side.

21. The assembly of claim 15, wherein core convex portions or core concave portions are provided at an outer peripheral surface of the core member, and holding concave portions or holding convex portions, that mesh-together with the core convex portions or the core concave portions, are provided at inner peripheral surfaces of the holding members.

22. An image forming device comprising:

a cleaning device that comprises:

a member to be cleaned that circulates or rotates, and the cleaning member of claim 1 that contacts the member to be cleaned and is slave-rotated accompanying circulation or rotation of the member to be cleaned; and a conveying member that conveys a recording medium onto which is transferred an image formed by using the member to be cleaned that has been cleaned by the cleaning device.

23. An image forming device comprising:

an assembly that is replaceably assembled with respect to a main body and that comprises:

an image holding body, a charging member that rotates and that charges an outer peripheral surface of the image holding body, and the cleaning member of claim 1 that contacts the charging member and is slave-rotated accompanying rotation of the charging member;

an exposure member that exposes the outer peripheral surface of the image holding body, that has been charged by the charging member, and forms an electrostatic latent image; and a developing member that makes the electrostatic latent image, that is formed on the outer peripheral surface of the image holding body, visible as a toner image.

* * * * *